US012252982B1

(12) United States Patent
Hunter

(10) Patent No.: US 12,252,982 B1
(45) Date of Patent: Mar. 18, 2025

(54) METHODS FOR CONDUCTING A PRESSURE TEST, AND SYSTEMS RELATING THERETO

(71) Applicant: Halliburton Energy Services, Inc., Houston, TX (US)

(72) Inventor: Timothy Holiman Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/370,684

(22) Filed: Sep. 20, 2023

(51) Int. Cl.
*E21B 47/117* (2012.01)
*E21B 43/26* (2006.01)
*E21B 47/06* (2012.01)

(52) U.S. Cl.
CPC ..... *E21B 47/117* (2020.05); *E21B 43/2607* (2020.05); *E21B 47/06* (2013.01)

(58) Field of Classification Search
CPC ..... E21B 43/2607; E21B 43/26
See application file for complete search history.

(56) References Cited

U.S. PATENT DOCUMENTS

| | | | | |
|---|---|---|---|---|
| 6,503,066 | B1 | 1/2003 | Cantley | |
| 9,709,456 | B1 | 7/2017 | Clover | |
| 11,237,076 | B2 | 2/2022 | Mazrooee et al. | |
| 11,293,227 | B2 | 4/2022 | Brunet | |
| 2007/0277982 | A1 * | 12/2007 | Shampine | E21B 43/25 166/308.1 |
| 2015/0197439 | A1 | 7/2015 | Zou et al. | |
| 2017/0212535 | A1 * | 7/2017 | Shelman | E21B 34/02 |
| 2018/0196446 | A1 * | 7/2018 | Imel | G05D 7/0688 |
| 2020/0340461 | A1 | 10/2020 | Surjaatmadja et al. | |
| 2021/0063271 | A1 | 3/2021 | Mazrooee et al. | |
| 2023/0083234 | A1 * | 3/2023 | Cook | E21B 43/2607 166/244.1 |
| 2023/0279758 | A1 * | 9/2023 | Bull | F16L 37/05 166/338 |

FOREIGN PATENT DOCUMENTS

WO 2019160538 A1 8/2019

OTHER PUBLICATIONS

Filing Receipt, Specification and Drawings for U.S. Appl. No. 18/136,453, filed Apr. 19, 2023, entitled "Electrically Powered Pumping Unit With Removable Pump Modules," 50 pages.

* cited by examiner

*Primary Examiner* — Brad Harcourt
(74) *Attorney, Agent, or Firm* — Conley Rose, P.C.; Rodney B. Carroll

(57) ABSTRACT

A method of conducting a pressure test on a piping and manifold system can include isolating a wellhead from fluid flow into a well to form a closed test system, operating at least one and less than all of the plurality of pumping units to pump fluid into and pressurize the closed test system to a first predetermined pressure, upon reaching the first predetermined pressure, halting pumping of fluid by the at least one of the plurality of pumping units, continuing pumping of fluid into the closed test system with at least one pressure test pump to pressurize the manifold and piping to a final predetermined pressure, and upon reaching the final predetermined pressure, halting pumping of the fluid by the at least one pressure test pump.

20 Claims, 4 Drawing Sheets

METHODS FOR CONDUCTING A PRESSURE TEST, AND SYSTEMS RELATING THERETO

FIELD

This application relates to methods of conducting a pressure test of surface equipment at a wellsite, and systems relating thereto. More specifically, this application relates to methods of conducting a pressure test by operating at least one pump of a pumping unit to reach a first predetermined pressure and a pressure test pump for reaching the final test pressure to pressurize an isolated fluid distribution system.

BACKGROUND

At a wellsite, several phases of drilling and completion operations are typically conducted, such as drilling, cementing, treating, producing, and secondarily treating, such as hydraulic fracturing treatments. Well stimulation, including fracturing, can be utilized by the oil and gas industry to increase the transfer of hydrocarbon resources from a reservoir formation to a wellbore. Pressurized fracturing fluid is introduced into a wellbore to generate fractures downhole in the reservoir formation. Typically, these pressures exceed the fracture gradient of the subterranean formation, and thus, place stress on the piping and equipment subject to these high operating pressures.

Periodically, in any of these phases, the piping and equipment used at the wellsite to conduct a job (e.g., fracturing operations) can be subject to pressure testing to determine if there are any leaks. Due to the particularly high pressures utilized during fracturing, pressure testing can be conducted to ensure the reliability of the equipment and for the protection of personnel. Thus, an ongoing need exists for improved systems and methods for performing pressure testing of fluid flow piping and equipment at a wellsite.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
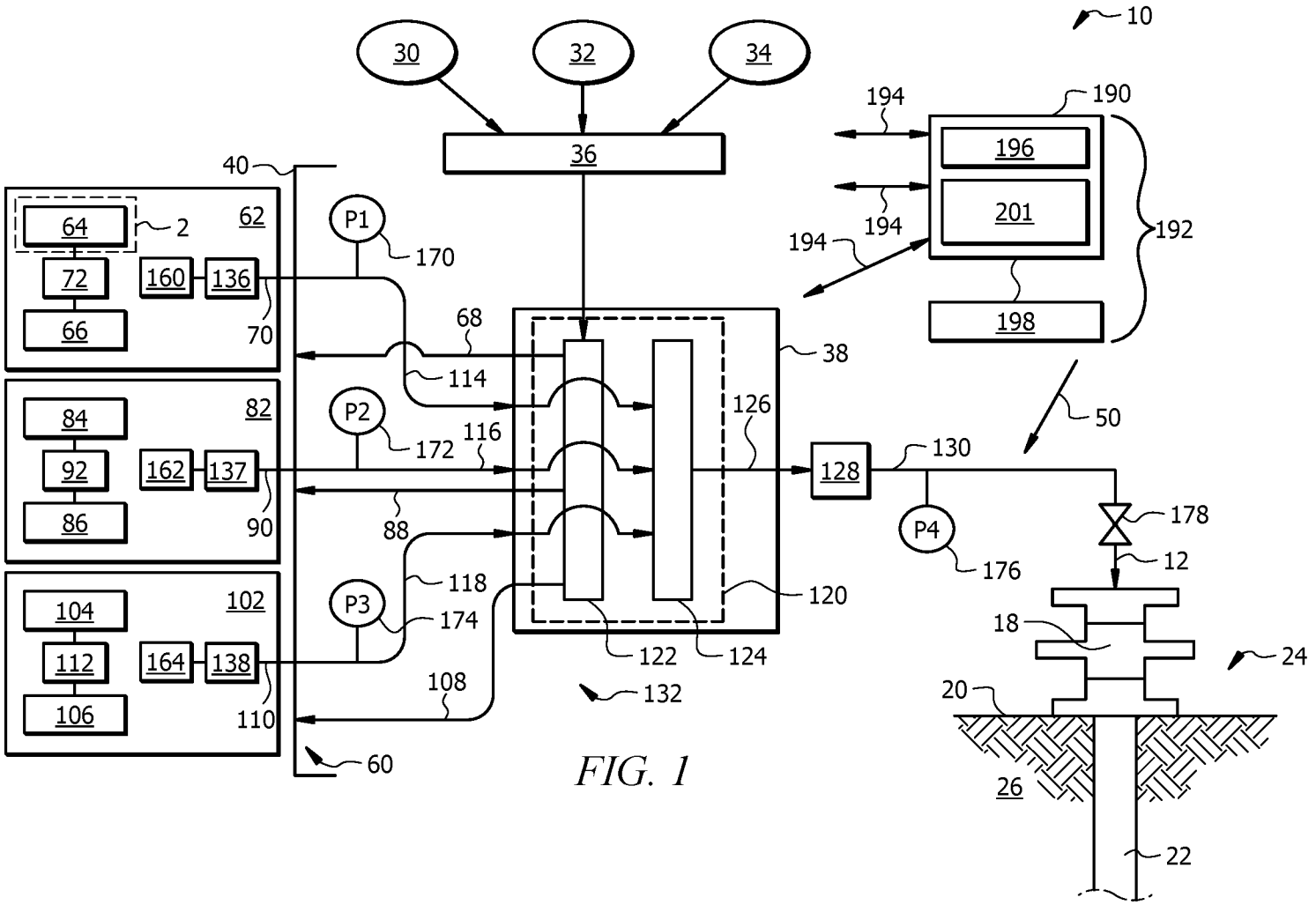
FIG. 1 is a schematic block diagram of an embodiment of a wellbore operational environment for conducting a pressure test.

In the following detailed description of the illustrative embodiments, reference is made to the accompanying drawings that form a part hereof. These embodiments are described in sufficient detail to enable those skilled in the art to practice the invention, and it is understood that other embodiments may be utilized, and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the term "fluid path" can be a path for the flow of fluid (i) from equipment such as a pumping unit into a wellbore and can be used for the production of fluids, such as hydrocarbons and water, or be used for the injection of fluids, such as fracturing fluids, and (ii) from a wellbore to equipment such as treatment vessels and can be used for the production of fluids such as hydrocarbons and water. The term "fluid path" may be used interchangeably with "line", "flowline", or "pipe" with respect to the drawings. Moreover, the terms "flowline", "pipe", and "line" may be used interchangeably.

As used herein, the term "pumping and piping manifold" or "piping and manifold system" can mean a zone of piping and equipment providing a fluid path to and from equipment and a well (e.g., wellhead), and capable of forming an isolated or a closed (test) system subject to pressurized fluid and pressure testing. This zone can include the discharges from one or more pumps, one or more manifolds, and piping to one or more valves isolating one or more respective wellheads. In the field, this zone may be referred to as a "frac-iron" or "frac-iron configuration" subject to high pressures during operations. Although the term "iron" may be utilized to describe the equipment and piping, such as the frac-iron, the equipment may be made from iron or any other suitable material other than iron depending on the type of operation.

As used herein, the term "fluid" may be a liquid or a gas, and includes an aqueous fluid that can be used during a pressure test.

As used herein, the term "at least one pumping unit and less than all of the plurality of pumping units" may be used to distinguish operating pumping units and non-operating pumping units. As an example, a number, such as one, of operating pumping units may be less than the total number of pumping units. As another example, one operating pumping unit for pressurizing a pumping and piping manifold can be one pumping unit of four pumping units with the other three pumping units being non-operating.

As used herein, the term "system" can include an oilfield platform or hydraulic fracturing spread including piping, one or manifolds, equipment, one or more fluids, one or more valves, one or more sensors, and a computer system for conducting one or more wellbore operations. The system can include a plurality of pumping units configured for fluid communication via frac-iron with one or more wellheads located at a wellsite.

As used herein, the term "fluid distribution system" can be a group of interrelated elements for distributing a fluid and can include one or more fluid sources, one or more lines, pipes, pumps, manifolds, and valves.

As used herein, the term "computer system" can be a group of interrelated elements acting to a set of rules and include one or more processors, memories, network interfaces, controllers, sensors, and buses for controlling or automating one or more wellbore operations.

As used herein, the terms "isolated system", "closed system", "closed test system", or "test shut-in system" and the like can mean an enclosed space permitting fluid entry, but not fluid exit except for intermittent purging of some liquids, to allow an increase in pressure for, in some embodiments, pressure testing, and can be accomplished for piping and equipment by, e.g., closing a valve, to, e.g., a wellbore. In an aspect, an isolated test system comprises the manifold 120 and all related piping providing a fluid path from a plurality of pumping units 62/82/102 to valve 178 associated with wellhead 18.

As used herein, the term "pumping unit" can include at least one pump and motor. In some instances, two or more pumps can be powered by a single motor. Generally, a pumping unit has a single motor. Usually, a pump in a pumping unit can be referred to as a fracturing pump.

As used herein, the term "network" or "piping network" can include lines or pipes extending to and from a manifold.

As used herein, the term "manifold" can be interconnected lines or pipes for distributing a fluid to different locations.

As used herein, the term "pressure cycle" can mean a continuous or intermittent process of increasing pressure from an initial pressure (e.g., ambient pressure) to a first, often predetermined, pressure, and then to a final or a second, often predetermined, pressure for a pressure test with at least one pump or pumping unit and a pressure test pump.

As used herein, the term "substantially" can mean very similar or at a particular orientation. In some embodiments, substantially, can mean within about 10 degrees, about 9 degrees, about 8 degrees, about 7 degrees, about 6 degrees, about 5 degrees, about 4 degrees, about 3 degrees, about 2 degrees, or about 1 degree with respect to horizontal or vertical.

As used herein, the term "upstream" can be construed as generally toward the pumping units and fluid flow typically occurs during process upsets, and possibly during pressure tests in the absence of check valves, and the term "downstream" can be construed as generally toward to the wellhead during normal operations, such as fluid fracturing operations, or pressure tests.

It is to be understood that "subterranean formation" encompasses both areas below exposed earth and areas below earth covered by water such as ocean or fresh water.

As used herein, the term "coupled" can mean two items, directly or indirectly, joined, fastened, associated, connected, or formed integrally together either by chemical or mechanical means, by processes including stamping, molding, or welding. What is more, two items can be coupled by the use of a third component such as a mechanical fastener, e.g., a screw, a nail, a staple, or a rivet; an adhesive; or a solder.

As used herein, the term "and/or" can mean one or more of items in any combination in a list, such as "A and/or B" means "A, B, or the combination of A and B".

During a typical pressure test, all the pumps are used to pressurize a fluid to a target or final pressure to check for leaks in piping and equipment, particularly the "frac-iron" exposed to high pressures from the pumps' discharge. Often, downstream of each pump is a check valve, typically spring-loaded. To test the entire system, including the pump discharge chambers, pressurized fluid is introduced upstream of each spring-loaded check valve to increase pressure throughout the system. To pressurize the entire frac-iron, all the pumps must be operated as the check valves prevent backward flow from the discharge manifold to the fluid end of the pumps. Any non-operating pumps would not be pressurized at their pump fluid end due to the check valve activating and preventing backward fluid flow. However, pumps can be damaged during pressure tests. It would be beneficial to pressure the system to the final test pressure with none of the pumps of the pumping units to minimize wear and tear to the pumps. The presently disclosed systems and methods advantageously allow for pressure testing an entire piping and manifold system (e.g., frac-iron of the type used to conduct hydraulic fracturing operations) by operating none of the pumping units, i.e., fracturing pumps, at the final test pressure.

In some embodiments, a method of conducting a pressure test on a piping and manifold system can be configured to provide fluid flow from a plurality of pumping units into a well via a wellhead. The method can include connecting the plurality of pumping units to a discharge manifold, connecting the wellhead of the well to the discharge manifold via a wellhead flowline, and isolating the wellhead from the fluid flow into the well to form a closed test system. The method can further include operating at least one and less than all of the plurality of pumping units to pump fluid into and pressurize the closed test system to a first predetermined pressure, upon reaching the first predetermined pressure, halting pumping of fluid by the at least one of the plurality of pumping units, continuing pumping of fluid into the closed test system with at least one pressure test pump to pressurize the manifold and piping to a final predetermined pressure, and upon reaching the final predetermined pressure, halting pumping of the fluid by the at least one pressure test pump. Generally, a fluid outlet on each of the plurality of pumping units is in fluid communication with the discharge manifold via a respective discharge flowline.

In some embodiments, a method of conducting a pressure test on a piping and manifold system can be configured to provide fluid flow from a plurality of pumping units into a well via a wellhead. The method can include connecting the plurality of pumping units to a discharge manifold, connecting the wellhead of the well to the discharge manifold via a wellhead flowline, isolating the wellhead from the fluid flow into the well to form a closed test system, pumping fluid into and pressuring the closed test system with at least one pressure test pump to pressurize the manifold and piping to a final predetermined pressure, and upon reaching the final predetermined pressure, halting pumping of fluid by the at least one pressure test pump. Generally, a fluid outlet on each of the plurality of pumping units is in fluid communication with the discharge manifold via a respective discharge flowline.

In some embodiments, a method of pressure testing a manifold and piping can be coupled to a wellhead and isolated from fluid flow through the wellhead. The method can include starting pumping of a fluid by one or more pumping units in fluid communication with the manifold and piping to pressurize the manifold and piping to a first predetermined pressure, upon reaching the first predetermined pressure, halting pumping of fluid by the one or more of a first number of pumping units, continuing pumping of fluid with at least one pressure test pump to pressurize the manifold and piping to a second predetermined pressure; and upon reaching the second predetermined pressure, halting pumping of the fluid by the at least one pressure test pump.

In some embodiments, a method is provided of preparing a piping and manifold system for a pressure test. The method includes pressuring from an initial pressure to a first predetermined pressure of at least about 1,000 psi, about 2,000 psi, about 3,000 psi, about 4,000 psi, about 5,000 psi, about 6,000 psi, about 7,000 psi, or about 8,000 psi, or equal to or less than about 1,000 psi, about 2,000 psi, about 3,000 psi, about 4,000 psi, about 5,000 psi, about 6,000 psi, about 7,000 psi, or about 8,000 psi with one or more pumps from at least one pumping unit. Sometimes, the first predetermined pressure can range from about 1,000 psi to about 5,000 psi, about 2,000 to about 4,000 psi, about 3,000 psi to about 5,000 psi, about 3,500 psi to about 4,500 psi, or about 3,800 psi to about 4,200 psi. Generally, the pressurizing to the first predetermined pressure compresses any residual gas in the closed system and allows the purging of liquids.

Afterwards, at least one pressure test pump can increase the pressure to a final or second predetermined pressure of at least about 5,000 psi, about 8,000 psi, about 10,000 psi, about 12,000 psi, about 14,000 psi, about 15,000 psi, about 20,000 psi, about 25,000 psi, or even about 30,000 psi, and a discharge manifold (e.g., a high pressure discharge manifold having a pressure of equal to or greater than about 1,000 psi, about 5,000 psi, about 8,000 psi, about 10,000 psi, about 12,000 psi, about 14,000 psi, about 15,000 psi, about 20,000 psi, about 25,000 psi, or about 30,000 psi) or a final or second predetermined pressure of about 5,000 psi to about 20,000 psi, about 10,000 psi to about 20,000 psi, 10,000 psi to about 14,000 psi, about 11,000 psi to about 13,000 psi, or about 11,500 psi to about 12,500 psi. In some embodiments, the final pressure is equal to or less than about 30,000 psi, about 20,000 psi, about 15,000 psi, or about 10,000 psi. The discharge manifold is connected via a flowline to a wellhead and the wellhead is isolated from the manifold via a closed valve. The piping and manifold system can be part of a hydraulic fracturing spread located at a wellsite and configured to pump high pressure fracturing fluid into the wellbore and surrounding formation.

In some embodiments, a system includes a pumping and piping system coupled to a wellhead of a well to form a closed system by closing a valve to prevent fluid flow through the wellhead and into the well. The pumping and piping system can include respective fluid outlets of a plurality of pumping units, and each of the respective fluid outlets is in fluid communication via a discharge flowline with a discharge manifold coupled via a wellhead flowline to the wellhead. The closed system is pressured to a first predetermined pressure with a fluid by using one or more of the plurality of pumping units, and to a final predetermined pressure using at least one pressure test pump.

In some embodiments, the fluid distribution system includes at least one pumping unit and a pumping and piping manifold. The at least one pumping unit can include any suitable number of pumps, such as one, two, three, or more. The each pump of the pumping unit can be a fracturing pump, and independently, has a power of at least about 2,000 horsepower (hp), about 3,000 hp, or about 4000 hp, or about 5000 hp. In some embodiments, the pumps can have a power of about 2,000 hp to about 5,000 hp, about 2,000 hp to about 4000 hp, or about 2000 hp to about 3000 hp.

In some embodiments, the fluid distribution system includes at least one pressure test pump. The pressure test pump can have much less power than the fracturing pump, but is suited to bring the fluid distribution system to the final predetermined test pressure. the pressure test pump can have greater than zero percent (e.g., 0.0001, 0.001, 0.01, 0.1%) and equal to or less than about one percent (1%) of the power of the fracturing pump, or equal to or less than about 2%, about 3%, about 4%, or about 5% of the power of the fracturing pump. In some embodiments, the pressure test pump can have a power of equal to or less than about 100 hp, about 90 hp, about 80 hp about 70 hp, about 60 hp, about 50 hp, about 40 hp, about 30 hp, about 20 hp, about 10 hp, about 9 hp, about 8 hp, about 7 hp, about 6 hp, about 5 hp, about 4 hp, about 3 hp, about 2 hp, about 1 hp, about 0.9 hp, about 0.8 hp, about 0.7 hp, about 0.6 hp, about 0.5 hp, about 0.4 hp, about 0.3 hp, about 0.2 hp, or about 0.1 hp. In some embodiment, the pressure test pump can have a power of at least about 0.1 hp, about 0.2 hp, about 0.3 hp, about 0.4 hp, about 0.5 hp, about 0.6 hp, about 0.7 hp, about 0.8 hp, about 0.9 hp, about 1 hp, about 2 hp, about 3 hp, about 4 hp, about 5 hp, about 6 hp, about 7 hp, about 8 hp, about 9 hp, or about 10 hp. In some embodiments, the pressure test pump can have a power of about 0.1 hp to about 100 hp, about 0.2 to about 70 hp, about 0.25 to about 50 hp, about 1 hp to about 25 hp, about 1 hp to about 20 hp, about 1 hp to about 15 hp, about 1 hp to about 10 hp, about 1 hp to about 5 hp, about 0.25 hp to about 25 hp, about 0.25 hp to about 20 hp, about 0.25 hp to about 15 hp, about 0.25 hp to about 10 hp, or about 0.25 hp to about 5 hp.

In some embodiments, a pressure test pump is typically not used during wellbore treatments or fracturing operations. In an aspect, the pressure test pump is used to pump equal to or less than 10, 9, 8, 7, 6, 5, 4, 3, 2, 1, 0.1, 0.001, 0.001, or 0.0 volume percent of the combined flow rate of the pumping system during operation of a pumping job. Usually, the pressure test pump is dedicated for use only during pressure tests and not configured for pumping wellbore fluids, such as fracturing fluids. In some embodiments, a pressure test pump is used during initial positioning and "rig-up" of a pumping system at a jobsite (e.g., wellsite) prior to performance of a wellbore servicing operation, and thereafter the pressure test pump may be removed from the pumping system to relocated to a different jobsite (e.g., remote from the first jobsite) to be used in pressure testing a different pumping system located at the different jobsite. Thus, the pressure test pump may represent a specialized, dedicated, and/or temporary piece of equipment that may be moved from site to site in order to perform pressure testing in contrast to standard, large volume high-pressure pumping units that are used to perform the wellbore servicing operation.

The pressure test pump can raise the pressure within the closed system to at least about 5,000 psi, about 8,000 psi, about 10,000 psi, about 12,000 psi, about 14,000 psi, about 15,000 psi, about 20,000 psi, about 25,000 psi, or about 30,000 psi, or about 5,000 psi to about 20,000 psi, 10,000 psi to about 14,000 psi, about 11,000 psi to about 13,000 psi, or about 11,500 psi to about 12,500 psi.

In some embodiments, any suitable pump may be used as a pressure test pump, for example a positive displacement pump. In an aspect, the pressure test pump can be crankshaft-driven, for example a plurality of plungers coupled to and driven by a crankshaft that is powered by a prime mover (e.g., combustion engine, electric motor, etc.). The pressure test pump can include a plunger pump, a piston pump, a pneumatic pump, other positive displacement pump, a gear pump, a linear-actuated pump, such as a syringe pump, a pneumatic-over-hydraulic, i.e., air-over-oil, intensifier pump, or a pressure intensifier (e.g., air-over-liquid or liquid-over-air), and the pressure test pump may be electrically driven, and such pumps may have horsepower ratings as further described herein. One exemplary intensifier pump is commercially available from Haskel Engineering and Supply Company of Burbank, California. The pressure test pump can be coupled at a variety of locations in a closed system for conducting a pressure test, and in some embodiments, the pressure test pump is coupled upstream and in fluid communication with a check valve. In some embodiments, the pressure test pump can be coupled to a fluid end of a pump of a pumping unit, such as at a discharge connection of the fluid end. In some embodiments, the pressure test pump can be coupled to a front, a bottom, or a top cover of a fluid end of a fracturing pump. Alternatively, the pressure test pump can be couple to a discharge flow line or a discharge manifold, upstream or downstream of a pump discharge check valve. The pressure test pump can be hydraulic or pneumatic and pressurize the system with any suitable fluid, such as air, and be based as an air-over-liquid or liquid-over-liquid system. During the pressure test, the flow rate may be equal to or less than five gallons per minute. In some embodiments, the number of pressure test pumps can equal the number of fracturing pumps if, e.g., check valves are present downstream of each fracturing pump.

Referring to FIG. 1, a schematic block diagram of an embodiment of a wellbore operational environment for conducting a pressure test is depicted. A system or hydraulic fracturing spread 10 can include a blender 36, a trailer 38 supporting a manifold 120, a piping and manifold system or a pumping and piping manifold 40, a wellhead 18, and a computer system 190 for employing apparatus, methods, and systems in accordance with embodiments disclosed herein. In some embodiments, the system 10 can be or include an oil and gas platform 10, a hydraulic fracturing spread 10, or a fluid distribution system 10. A hydraulic fracturing spread is depicted in FIG. 1.

The system 10 can optionally be configured for automatic pressure testing, although the pressure testing can be tested manually. As depicted FIG. 1, a well 24 can include a wellbore 22 capped by the wellhead 18 extending from a surface 20, such as the earth's surface, and downward into a subterranean formation 26. The wellbore 22 may include a casing that encloses at least some of the wellbore 22 extending from surface 20 into the subterranean formation 26 to some depth extending away from a top opening of the wellbore 22 at the surface 20. A choke valve comprising one or more connections and/or shut-off valves may be positioned at the top opening, and arranged to couple to the casing and thus seal off the borehole relative to the piping and equipment above surface 20. In some embodiments, a valve 178 may be used to isolate the wellbore 20 to create a closed or shut-in test system 50, and may be operated manually or automatically.

During normal operations, such as fracturing operations, one or more fluids, such as fracturing fluids, are introduced as a fluid flow 12 into the subterranean formation 26, as discussed further below.

The system 10 can include the pumping and piping manifold 40 subject to the high pressures during fracturing operations, thus is subjected to pressure testing to ensure viability of piping and equipment. The pumping and piping manifold 40 can include the discharges or fluid outlets 70, 90, and 110 from respective pumping units discussed hereinafter, a manifold 120, and a piping 130 to the valve 178. The manifold 120 can include a low pressure suction manifold 122 and a high pressure discharge manifold 124 supported by the trailer 38. The manifold 120 can have a manifold outlet line 126, which in turn communicates with at least wellhead flowline, one or more lines or one or more pipes 130, such as a wellhead flowline 130, with the wellhead 18. The system 10 can further include a plurality of pumping units 60, such as a first pumping unit 62, a second pumping unit 82, and a third pumping unit 102.

Figure 2:
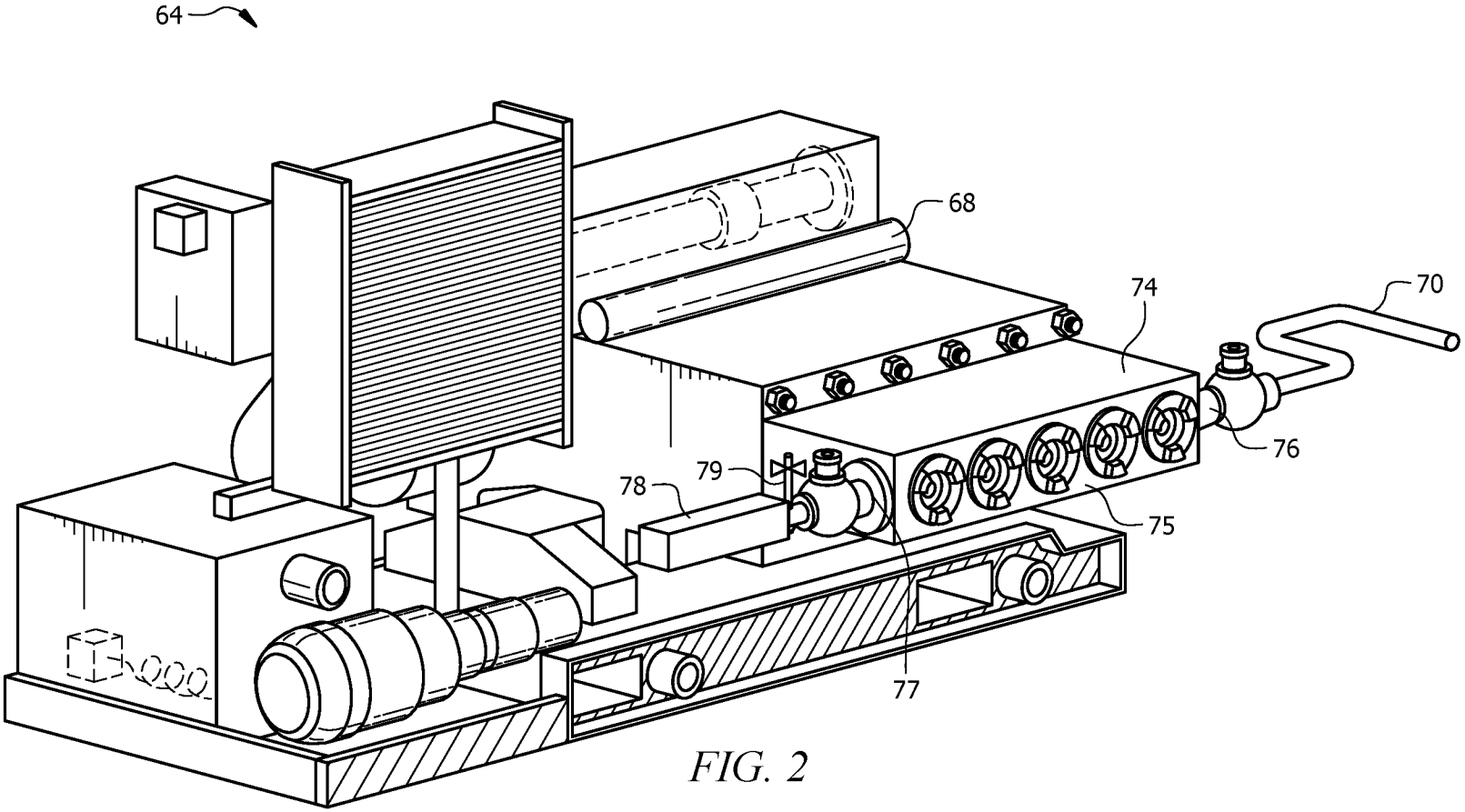
FIG. 2 is a schematic of an embodiment of a pump.

Referring to FIGS. 1-2, the first pumping unit 62 can include at least one pump, such as a first pump 64 and a second pump 66 powered by a motor 72, and a controller 160. Although two pumps 64 and 66 are depicted, any suitable number of pumps, such as one, two, three, four, or more may be included in a first pumping unit 62. Similarly, a second pumping unit 82 can include pumps 84 and 86, a motor 92, and a controller 162, and a third pumping unit 102 can include pumps 104 and 106, a motor 112, and a controller 164. The pumps 64 and 66 can communicate at a common connection with the fluid outlet 70, the pumps 84 and 86 can communicate at a common connection with the fluid outlet 90, and the pumps 104 and 106 can communicate at a common connection with the fluid outlet 110. In some embodiments each pump of the respective pumping unit can have a check valve at or downstream of each pump's fluid outlet. The second pumping unit 82 and third pumping unit 102 can include any suitable number of pumps, similar to the first pumping unit 62. A network 132 of one or more pipes, including suction lines 68, 88, and 108 and discharge or pump lines 114, 116, and 118 can communicate the manifold 120 with the plurality of pumping units 60.

The system 10 can also include a computer system 190 for control and/or automation. The computer system 190 may also include one or more sets of communication links 194 that allow computer system 190 to communicate with other devices included within the system 10. In some embodiments, the computer system 190 can include a display 196, one or more input and/or output devices 198, a processor 201, and the one or more communication links 194, in this exemplary embodiment three communication links 194. The display 196, one or more input and/or output devices 198, and the processor 201 can be comprised in a computer controller 192. The system 10 can also include one or more sensors, such as pressure sensors, 170, 172, 174, and 176, and a control valve 128 downstream of the manifold 120. Each of pressure sensors 170, 172, 174, and 176, may be configured to provide an output, such as an electrical output signal, that is indicative of the pressure level that is present in the respective pump discharges or fluid outlets 70, 90, and 110 or the one or more pipes 130 to which the sensor 176 is coupled. Another embodiment of a computer system 190 is discussed below.

The system 10 may further include sources for fluids and additives for wellbore operations. In some embodiments, the system 10 can include a sand and/or proppant source 30, a pressure test fluid source 32, and one or more additions source 34. The pressure test fluid source 32 can be an aqueous fluid, such as fresh water, surface water, ground water, produced water, salt water, sea water, brine (e.g., underground natural brine, formulated brine, etc.), and combinations thereof. The pressure test fluid source 32 can be provided to the manifold 120. The manifold 120, in turn, can communicate with the plurality of pumping units 60 via suction lines 68, 88, and 108 to respective pumping units 62, 82, and 102.

Referring to FIG. 2, the pump 64 of the pumping unit 62 is depicted in further detail. The pump 64 includes the suction line 68 and the pump fluid end 74 and can be representative of other pumps 66, 84, 86, 104, and 106, although the pumps 64, 66, 84, 86, 104, and 106 can be the same or different. Each fluid outlet on the one or more pumping units is in fluid communication with one or more pump fluid ends, e.g., a fluid end having a plurality of reciprocating plungers disposed within corresponding substantially horizontal fluid bores such as a triplex plunger pump or a quintuplex plunger pump. The reciprocating plungers can reciprocate within respective bores during suction and discharge strokes. In this exemplary pump 64, the pump fluid end 74 can have a body 75 with a first discharge connection 76 or a port 76 and a second discharge connection 77 or another port 77. The first discharge connection 76 can be coupled to the fluid outlet 70 and the second discharge connection 77 can be coupled to a pressure test pump 78 having a relief valve 79.

Several operations or conditions can take place in the system 10. In normal operations, such as fracturing, the fluid flow 12 can be introduced past the open valve 178 near the wellhead 18. Generally, a fracturing fluid from the blender 36 is provided to the low pressure suction manifold 122 to the plurality of pumping units 60. The fracturing fluid passes through the velocity fuses of each respective pump to the discharge manifold 124 and through the wellhead flowline 130 past the open valve 178 through the wellhead 18 and into the wellbore 22 and surrounding subterranean formation 26.

During pressure testing, the valve 178 is closed stopping fluid flow past the wellhead 18 into the subterranean formation 26. An aqueous fluid from the pressure test fluid source 32 is pumped by a pump, such as the pump 64 of the pumping unit 62, while the other pumps 66, 84, 86, 104, and 106 are non-operational. Alternatively, one or more of the other pumps 66, 84, 86, 104, and 106 can be operational to raise pressure to the first predetermined pressure. These pumps 64, 66, 84, 86, 104, and 106 can also purge any residual liquids from a closed system 50 or a closed test system 50. Next, the pressure test pump 78 can pressurize the piping and manifold system 40 to the final predetermined pressure. As depicted in FIG. 2, only one pressure test pump 78 corresponds to each respective pump 64. Referring to FIG. 1, six pressure test pumps can be used to correspond to each pump 64, 66, 84, 86, 104, and 106. In some embodiments, only a single pressure test pump may be utilized if no check valves are present, or if pressurization is desired downstream of the check valves. Regarding the latter, the pressure test pump 78 can be positioned downstream of a check valve to pressurize the closed system 50 downstream of the check valves present in the pumping and piping manifold 40.

Pressure testing may be performed in order to determine if leaks exist in the system 10, and/or to confirm that the system 10 is adequately configured to withstand the maximum fluid pressures that equipment and piping may be exposed during a fracturing process.

Figure 3:
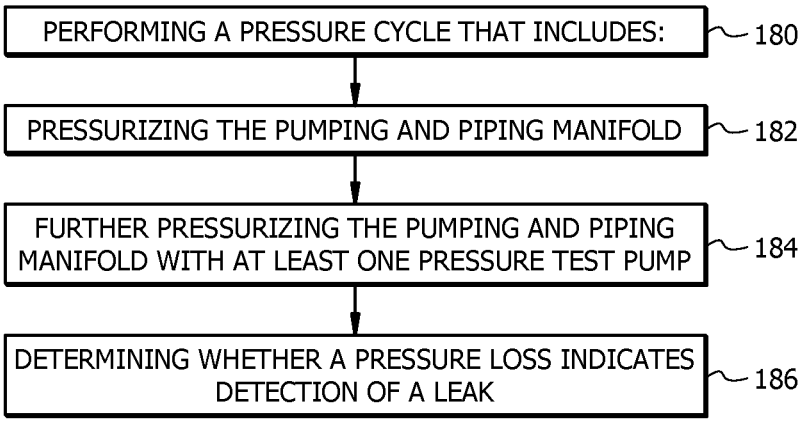
FIG. 3 is a flowchart of an embodiment of a method of conducting a pressure test.

Referring to FIG. 3, a pressure test can include performing a pressure cycle 180. The pressure cycle 180 can include pressurizing the pumping and piping manifold 182 to a first predetermined pressure, further pressurizing the pumping and piping manifold with at least one pressure test pump 184 to a final predetermined pressure, and determining whether a pressure loss is indicative of a leak 186. Generally, the pressure test is conducted on the pumping and piping manifold 40 that includes fluid outlets 70, 90, and 100, the discharge flowlines 114, 116, and 118, manifold 120, the manifold outlet line 126, and the one or more lines 130, such as the wellhead flowline 130, to the closed valve 178.

Figure 4:
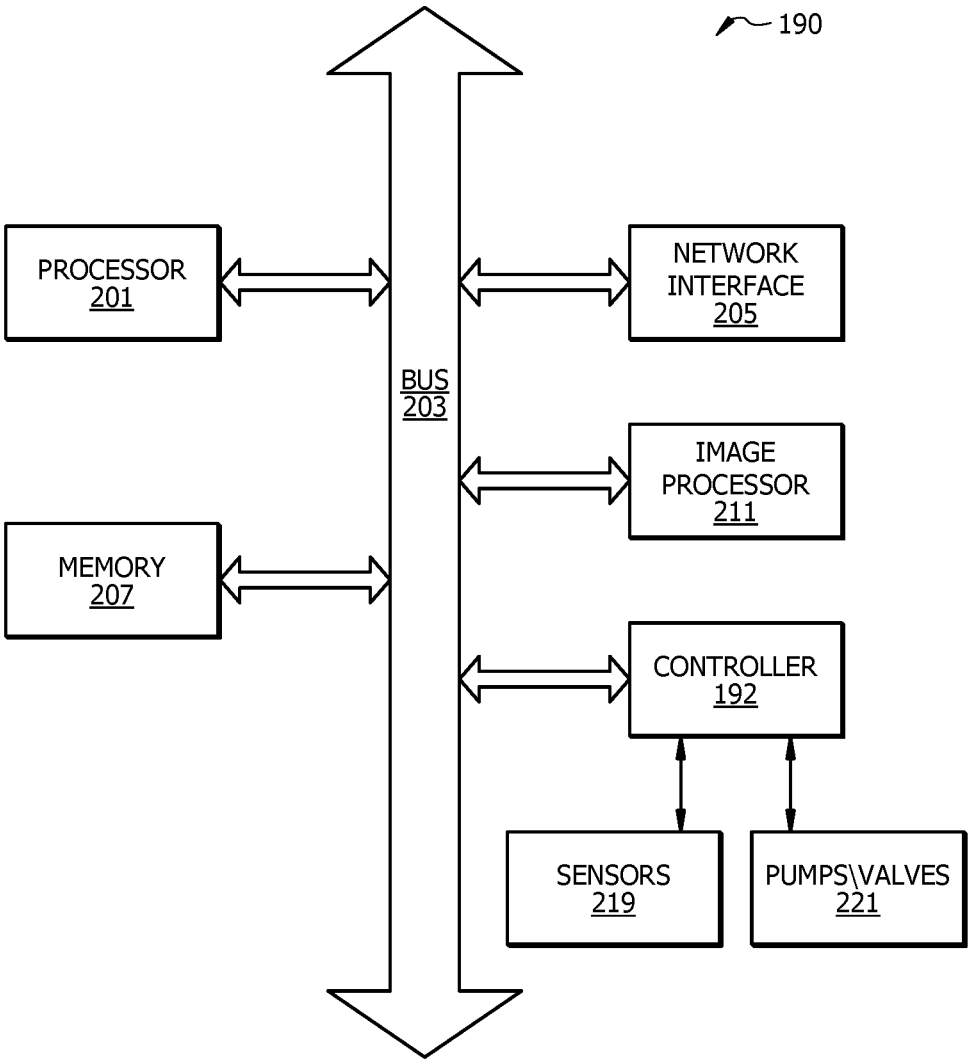
FIG. 4 is a block diagram of an embodiment of a computer system for implementing a pressure test.

Referring to FIG. 4, in some embodiments the computing system 190 may be a general-purpose computer, and includes a processor 201 (possibly including multiple processors, multiple cores, multiple nodes, and/or implementing multi-threading, etc.). The computer can include a memory 207. The memory 207 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the possible realizations of machine-readable media. The computer system also includes a bus 203 (e.g., PCI, ISA, PCI-Express, HyperTransport® bus, InfiniBand® bus, NuBus, etc.) and a network interface 205 (e.g., a Fiber Channel interface, an Ethernet interface, an internet small computer system interface, SONET interface, wireless interface, etc.).

The computer may also include an image processor 211 and a controller 192. The controller 192 can control the different operations that can occur in the response inputs from the sensors 219 and/or calculations based on inputs from the sensors 219 (such as the sensors 170, 172, 174, and 176 of the system 10, as depicted in FIG. 1) using any of the techniques described herein, and any equivalents thereof, to provide outputs to control the pumps/valves 221. For example, the controller 192 can communicate instructions to the appropriate equipment, devices, etc. to alter control number and/or the horsepower setting use by pumps, (such as the pumps 64, 66, 84, 86, 104, and 106, as depicted in FIG. 1) and/or to set and control valves (such as the valve 128 as illustrated in FIG. 1) that may be utilized in an automatic pressure testing procedure. Any one of the previously described functionalities may be partially (or entirely) implemented in hardware and/or on the processor 201. For example, the functionality may be implemented with an application specific integrated circuit, in logic implemented in the processor 201, in a co-processor on a peripheral device or card, etc. Further, realizations may include fewer or additional components not illustrated in FIG. 4 (e.g., video cards, audio cards, additional network interfaces, peripheral devices, etc.). As illustrated in FIG. 4, the processor 201 and the network interface 205 are coupled to the bus 203. Although illustrated as also being coupled to the bus 203, the memory 207 may be coupled to the processor 201 only, or both the processor 201 and bus 203.

The controller 192 may be coupled to the sensors 219 and to the pumps/valves 221 using any type of wired or wireless connection(s), and may receive data, such as measurement data, obtained by the sensors 219 or provided by the pumps/valves 221. The sensors 219 may include any of the sensors associated with a wellbore environment, including but not limited to the pressure sensors configured to output signals indicative of pressure level within a pumping and piping manifold 40. Measurement data may include any of the data associated with an automatic pressure testing procedure. The controller 192 may include circuitry, such as analog-to-digital (A/D) converters and buffers that allow the controller 192 to receive electrical signals directly from one or more of the sensors 219.

The processor 201 may be configured to execute instruction that provide control over an automatic pressure testing procedure as described in this disclosure, and any equivalents thereof. For example, the processor 201 may control operations of one or more pumps being utilized to pressurize the pumping and piping manifold 40 as part of an automatic pressure testing procedure. Control of pumps may include determining a set of predefined pump configurations, wherein a particular one of the predefined pump configurations are assigned to be used during each of a plurality of pressure testing cycles, and providing output signal, for example to controller(s) located at the pumps, to configure and control the operations of the pumps at each pressure testing cycle according to the predefined pump configuration that is to be applied to that particular pressure testing cycle. The processor 201 may also be configured to receive output signals generated by the sensors 219, to process the signals to generate pressure level data, and to utilize that pressure level data to determine if a leak or leaks have been detected as a result of the pressure testing procedure. The processor 201 may also be configured to support any interaction between a system user and the computer system 190, including generating for display output information related to the results obtained from running an automatic pressure testing procedure on the pumping and piping manifold 40, and receive and process inputs provide by a system user to the computer system 190, for example regarding how to proceed with the automatic pressure testing procedure when leaks are detected by the procedure.

With respect to the computing system 190, the basic features here may easily be substituted for improved hardware or firmware arrangements as they are developed. In some examples, the memory 207 includes non-volatile memory and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 190 or as a general purpose computer, some embodiments can be any type of device or apparatus to perform operations described herein.

Automatic pressure testing procedures performed by for the system 10 may be controlled at least in part by the computer system 190. The computer system 190 may include one or more processors, which for simplicity are hereinafter referred to as the processor 201. The processor 201 is not limited to any particular type of processor, and may include multiple processors and/or different types of processors, such as a general processor and an image processor. The processor 201 may be coupled to memory, (such as the memory 207 as shown in FIG. 4), that stores programs, algorithms, and parameter values that the processor 201 operates on to perform the automatic pressure testing procedures performed for a pressure test. The computer system 190 may include the display 196, which may be an interactive display such as a touch screen. The computer system 190 may including one or more I/O devices 198, such as but not limited to a computer keyboard, a computer mouse, or other known devices that allow a system operator, such as a technician or engineer, to interact with the computer system 190.

The computer system 190 may also include the one or more sets of communication links 194. For example, the communication links 194 may be configured to communicatively couple the computer system 190 to the pumps 64, 66, 84, 86, 104, and 106, for example to communicate with the controllers 160, 162, and 164 located at the pumping units 62, 82, and 102. The communication link(s) 194 may also provide the computer system 190 with communication capabilities that allow the computer system 190 to have control over the valves, such as the valve 128. The communication link 194 may be configured to communicatively couple the computer system 190 to the sensors 170, 172, 174, and 176, for example to receive electrical signal outputs corresponding to pressure sensor reading being made by these sensors 170, 172, 174, and 176. The communication links 194 may be configured to communicatively couple computer system 190 to devices located at the manifold 120, for example to control the coupling and decoupling functions that may be provided by these control valves. The communication links 194 are not limited to any particular type of communication link, communication medium, or communication formats, and may include any combination of communication links, mediums, and formats determined to be appropriate for use in the wellbore environment where the pressure test may be utilized.

The computer system 190 may be configured to control or provide control commands to the controllers 160, 162, 164 of the pumps 64, 66, 84, 86, 104, and 106 to control the operation of the pumps in conjunction with control valves to automatically perform one continuous pressure cycle, or two or more discontinuous pressure cycles. In addition, the computer system 190 may be configured to receive the output signals provided by the sensors 170, 172, 174, and 176, and other sensors that may be part of the pressure test. By controlling and monitoring these devices, the computer system 190 may perform an automatic pressure testing procedure on the pumping and piping manifold 40 as illustrated and described with respect to FIG. 1, using various predefined test parameters and test values to render a leak test status.

Additional Disclosure

The following are non-limiting, specific embodiments in accordance with the present disclosure:

A first embodiment which is a method of conducting a pressure test on a piping and manifold system 40 configured to provide fluid flow from a plurality of pumping units 60 into a well 24 via a wellhead 18, comprises: connecting the plurality of pumping units 60 to a discharge manifold 124, wherein a fluid outlet 70, 90, and 110 on each of the plurality of pumping units 60 is in fluid communication with the discharge manifold 124 via a respective discharge flowline 114, 116, and 118; connecting the wellhead 18 of a well 24 to the discharge manifold 124 via a wellhead flowline 130; isolating the wellhead 18 from fluid flow 12 into the well 24 (by closing a valve 178 on or upstream from the wellhead 18) to form a closed test system 50; operating at least one (e.g., just one) and less than all of the plurality of pumping units 60 to pump fluid into and pressurize the closed test system 50 to a first predetermined pressure; upon reaching the first predetermined pressure, halting pumping of fluid by the at least one of the plurality of pumping units 60; continuing pumping of fluid into the closed test system 50 with at least one pressure test pump 78 to pressurize the manifold 120 and piping 130 to a final predetermined pressure; and upon reaching the final predetermined pressure, halting pumping of fluid by the at least one pressure test pump 78.

A second embodiment which is a method of the first embodiment wherein the pressure test pump 78 comprises any suitable pump, such as a pneumatic pump, a positive displacement pump, a gear pump, a piston pump, or a pressure intensifier.

A third embodiment which is the method of the first embodiment or second embodiment wherein the pressure test pump 78 is electrically driven.

A fourth embodiment which is the method of any of the proceeding embodiments wherein pressure test pump 78 has a horsepower equal to or less than 1% of a horsepower of each of the plurality of pumping units 60.

A fifth embodiment which is the method of any of the proceeding embodiments wherein each discharge flowline 114 comprises a respective check valve 136 located between the discharge manifold 124 and the respective fluid outlet 70, 90, and 110 of each of the plurality of pumping units 60.

A sixth embodiment which is the method of any of the proceeding embodiments wherein fluid flow from the pressure test pump 78 enters the closed test system 50 upstream of one or more of the check valves 136, 137, and 138.

A seventh embodiment which is the method of any of the proceeding embodiments wherein each of the plurality of pumping units 60 comprises a fluid end 74 having a body 75 with a first discharge connection 76 and a second discharge connection 77 and wherein the discharge flowline 114 is coupled to the first discharge connection 76 and the pressure test pump 78 is coupled to the second discharge connection 77.

An eighth embodiment which is the method of any of the proceeding embodiments wherein fluid flows from the pressure test pump 78 into the body 75 via the second discharge connection 77 and exits the body 75 via the first discharge connection 76.

A ninth embodiment which is the method of any of the proceeding embodiments wherein fluid flows from the first discharge connection 76 through the respective discharge flow line 114 and the respective check valve 136 to the manifold 120.

A tenth embodiment which is the method of any of the proceeding embodiments wherein the body 75 further comprises a plurality (e.g., a triplex or quintuplex) of horizontally spaced bores each having a plunger disposed therein and configured to reciprocate within the bore during suction and discharge strokes.

An eleventh embodiment which is the method of any of the proceeding embodiments wherein each pumping unit 62, 82, and 102 comprises two fluid ends 74 and two pressure test pumps 78, and each fluid end 74 has a respective pressure test pump 78 connected to the respective second discharge connection 77.

A twelfth embodiment which is the method of any of the proceeding embodiments wherein the pumping unit 62 comprises an electric motor 72 coupled to the two fluid ends 74 and configured to reciprocate the plungers.

A thirteenth embodiment which is the method of any of the proceeding embodiments wherein the first predetermined pressure is about 3,000 to about 5,000 psi and the final predetermined pressure is in a range of from about 10,000 to about 20,000 psi.

A fourteenth embodiment which is the method of any of the proceeding embodiments wherein fluid flow from the at least one pressure test pump 78 enters the closed test system 50 upstream of two or more of the check valves 136 and 137.

A fifteenth embodiment which is the method of any of the proceeding embodiments wherein fluid flow from the at least one pressure test pump 78 enters the closed test system 50 upstream of all of the check valves 136, 137, and 138.

A sixteenth embodiment which is the method of any of the proceeding embodiments wherein the at least one pressure test pump 78 further comprises a plurality of pressure test pumps 78, wherein a total number of the plurality of pressure test pumps 78 is the same as a total number of the plurality of pumping units 60.

A seventeenth embodiment which is the method of any of the proceeding embodiments wherein fluid flow from the at least one pressure test pump 78 enters the closed test system 50 upstream of all of the check valves 136, 137, and 138.

An eighteenth embodiment which is the method of any of the proceeding embodiments wherein the at least one pressure test pump 78 further comprises a plurality of pressure test pumps 78, wherein a total number of the plurality of pressure test pumps 78 is the same as a total number of the plurality of pumping units 60.

A nineteenth embodiment which is a method of conducting a pressure test on a piping and manifold system 40 configured to provide fluid flow from a plurality of pumping units 60 into a well 24 via a wellhead 18, comprises: connecting the plurality of pumping units 60 to a discharge manifold 124, wherein a fluid outlet 70 on each of the plurality of pumping units 60 is in fluid communication with the discharge manifold 124 via a respective discharge flowline 114; connecting the wellhead 18 of a well 24 to the discharge manifold 124 via a wellhead flowline 130; isolating the wellhead 18 from fluid flow into the well 24 (by closing a valve 178 on or upstream from the wellhead 18) to form a closed test system 50; (continuously) pumping fluid into and pressuring the closed test system 50 with at least one pressure test pump 78 to pressurize the manifold 120 and piping 130 to a final predetermined pressure; and upon reaching the final predetermined pressure, halting pumping of fluid by the at least one pressure test pump 78.

A twentieth embodiment which is the method of the nineteenth embodiment wherein each discharge flowline 114 comprises a respective check valve located 136 between the discharge manifold 124 and the respective fluid outlet 70 of each of the plurality of pumping units 60 and wherein fluid flow from the pressure test pump 78 enters the closed test system 50 upstream of one or more of the check valves 136.

A twenty-first embodiment which is a method of pressure testing a manifold 120 and piping 130 coupled to a wellhead 18 and isolated from fluid flow through the wellhead 18, comprises: starting pumping of a fluid by one or more pumping units 60 in fluid communication with the manifold 120 and piping 130 to pressurize the manifold 120 and piping 130 to a first predetermined pressure; upon reaching the first predetermined pressure, halting pumping of fluid by the one or more of the first number of pumping units 60; continuing pumping of fluid with at least one pressure test pump 78 to pressurize the manifold 120 and piping 130 to a second predetermined pressure; and upon reaching the second predetermined pressure, halting pumping of fluid by the at least one pressure test pump 78.

A twenty-second embodiment which is a method, comprises performing a pressure test on a fluid distribution system 10 comprising a plurality of pumping units 60 in fluid communication with a wellhead 18 via a manifold 120, wherein the pressure test comprises: pressurizing the fluid distribution system 10 with at least one pumping unit 62 from a first test pressure to a predetermined pressure, further pressurizing the pumping and piping manifold 40 with at least one pressure test pump 78 from the predetermined pressure to reach a final pressure.

A twenty-third embodiment which is a method of the twenty-second embodiment wherein the pressure test pump 78 is in fluid communication with the manifold 120 upstream of a check valve 136 positioned in a discharge 70.

A twenty-fourth embodiment which is a method of the twenty-second embodiment or twenty-third embodiment wherein each of the plurality of pumping units 62, 82, and 102 comprises a motor 72, 92, 112 and at least one pump 64, 84, and 104.

A twenty-fifth embodiment which is a method of any of the twenty-second embodiment through twenty-fourth embodiment wherein each pump 64 has a fluid end 74 with one or more ports for discharging a fluid and to provide fluid communication with a respective pressure test pump 78.

A twenty-sixth embodiment which is a method of any of the twenty-second embodiment through twenty-fifth embodiment wherein the pressure test pump 78 comprises a pneumatic pump, a positive displacement pump, or a gear pump.

A twenty-seventh embodiment which is a method of any of the twenty-second embodiment through twenty-sixth embodiment wherein the at least one pressure test pump 78 is upstream of a check valve 136.

A twenty-eighth embodiment which is a method of any of the twenty-second embodiment through twenty-seventh embodiment wherein each of the plurality of pumping units 62, 82, and 102 comprises at least two pumps 64, 66; 84, 86; 104, and 106.

A twenty-ninth embodiment which is a method of any of the twenty-second embodiment through twenty-eighth embodiment wherein each pump 64 of the plurality of pumping units 62, 82, 102 has a respective fluid end 74 coupled to a respective pressure test pump 78.

A thirtieth embodiment which is a method of any of the twenty-second embodiment through twenty-ninth embodiment wherein discharges 70, 90, 110 of the plurality of pumping units 60, one or more lines 114, 116, 118, and 130, and the manifold 120 are comprised a pumping and piping manifold 40.

A thirty-first embodiment which is a method of any of the twenty-second embodiment through thirtieth embodiment wherein the at least one pumping unit 62 ceases pumping after reaching the predetermined pressure.

A thirty-second embodiment which is a method of any of the twenty-second embodiment through thirty-first embodiment wherein the pressure test is conducted in a closed system 50.

A thirty-third embodiment which is a method of any of the twenty-second embodiment through thirty-second embodiment wherein the predetermined pressure is equal to or less than about 4,000 psi.

A thirty-fourth embodiment which is a method of any of the twenty-second embodiment through thirty-third embodiment wherein the predetermined pressure is equal to or less than about 6,000 psi.

A thirty-fifth embodiment which is a method of any of the twenty-second embodiment through thirty-fourth embodiment wherein the predetermined pressure is about 3,000 to 6,000 psi.

A thirty-sixth embodiment which is a method of any of the twenty-second embodiment through thirty-fifth embodiment wherein the final pressure is at least about 10,000 psi.

A thirty-seventh embodiment which is a method of any of the twenty-second embodiment through thirty-sixth embodiment wherein the final pressure is equal to or less than about 30,000 psi.

A thirty-eighth embodiment which is a method of any of the twenty-second embodiment through thirty-seventh embodiment wherein the final pressure is about 10,000 psi to about 14,000 psi.

A thirty-ninth embodiment which is a method of any of the twenty-second embodiment through thirty-eighth embodiment wherein respective discharges 70, 90, and 110 of each pumping unit 62, 82, and 102 is in direct fluid communication with the manifold 120.

A fortieth embodiment which is a method of any of the twenty-second embodiment through thirty-ninth embodiment wherein the motor 72 comprises an electric motor.

A forty-first embodiment which is a method of any of the twenty-second embodiment through fortieth embodiment wherein the pressure test pressurizes an aqueous fluid.

A forty-second embodiment which is a method of any of the twenty-second embodiment through forty-first embodiment wherein the plurality of pumping units 60 and the manifold 120 are above a surface 20.

A forty-third embodiment which is a fluid distribution system, comprises: a pumping and piping manifold 40 for containing and delivering a pressurized fluid to a wellhead 18; a plurality of pumping units 60 in fluid communication with the pumping and piping manifold 40, the plurality of pumping units 60 configured to provide the pressurized fluid; one or more sensors 170, 172, 174, and 176 configured to monitor one or more fluid pressures within the pumping and piping manifold 40; and a controller 192 configured to automatically control an operation of the plurality of pumping units 60 and to perform a pressure test, wherein the pressure test comprises: pressurizing the pumping and piping manifold 40 with an aqueous fluid from an initial pressure to a first predetermined pressure within the pumping and piping manifold 40 using the plurality of pumping units 60 to obtain the first predetermined pressure and ceasing pumping with the plurality of pumping units 60, further pressurizing the pumping and piping manifold 40 using a pressure test pump 78 to raise the pressure from the first predetermined pressure to a final or second pressure, monitoring, based on output signal from the one or more sensors 170, 172, 174, and 176, one or more measured pressures within the pumping and piping manifold 40 at one or more times during an evaluation time period beginning once the predetermined pressure within the pumping and piping manifold 40 has been reached, including monitoring a bleed off pressure, and determining whether a pressure loss or a rate of loss in the pumping and piping manifold 40 exceeds a maximum bleed off or rate of loss value.

A forty-fourth embodiment which is a fluid distribution system of forty-third embodiment, further comprising continuing monitoring after the final pressure is reached.

A forty-fifth embodiment which is a fluid distribution system of forty-third embodiment or forty-fourth embodiment wherein the pressure test pump 78 is upstream of a check valve 136 positioned in a discharge 70.

A forty-sixth embodiment which is a fluid distribution system of any of the forty-third embodiment through the forty-fifth embodiment wherein each of the plurality of pumping units 60 comprises a motor 72 and at least one pump 64.

A forty-seventh embodiment which is a fluid distribution system of any of the forty-third embodiment through the forty-sixth embodiment wherein the motor 72 comprises an electric motor.

A forty-eighth embodiment which is a fluid distribution system of any of the forty-third embodiment through the forty-seventh embodiment wherein each pump 64 has a fluid end 74 with a port 76 for discharging a fluid and another port 77 in fluid communication with a respective pressure test pump 78.

A forty-ninth embodiment which is a fluid distribution system of any of the forty-third embodiment through the forty-eighth embodiment wherein the pressure test pump 78 comprises a pneumatic pump, a positive displacement pump, or a gear pump.

A fiftieth embodiment which is a fluid distribution system of any of the forty-third embodiment through the forty-ninth embodiment wherein the at least one pumping unit 62 ceases pumping after reaching the predetermined pressure.

A fifty-first embodiment which is a fluid distribution system of any of the forty-third embodiment through the fiftieth embodiment wherein the pressure test is conducted in a closed system 50.

A fifty-second embodiment which is a fluid distribution system of any of the forty-third embodiment through the fifty-first embodiment wherein a valve 178 is closed upstream of the wellhead 18.

A fifty-third embodiment which is a fluid distribution system of any of the forty-third embodiment through the fifty-second embodiment wherein the first predetermined pressure is equal to or less than about 5,000 psi.

A fifty-fourth embodiment which is a fluid distribution system of any of the forty-third embodiment through the fifty-third embodiment wherein the first predetermined pressure is equal to or less than about 4,000 psi.

A fifty-fifth embodiment which is a fluid distribution system of any of the forty-third embodiment through the fifty-fourth embodiment wherein the first predetermined pressure is about 3,000 to 5,000 psi.

A fifty-sixth embodiment which is a fluid distribution system of any of the forty-third embodiment through the fifty-fifth embodiment wherein the final pressure is equal to or less than about 30,000 psi.

A fifty-seventh embodiment which is a fluid distribution system of any of the forty-third embodiment through the fifty-sixth embodiment wherein the pumping and piping manifold 40 comprises respective discharges 70, 90, and 110 of the plurality of pumping units 60, one or more lines 114, 116, 118, and 130, and a manifold 120.

A fifty-eighth embodiment which is a fluid distribution system of any of the forty-third embodiment through the fifty-seventh embodiment wherein the respective discharge 70, 90, and 110 of each pumping unit 60 is in direct fluid communication with the manifold 120.

A fifty-ninth embodiment which is a fluid distribution system of any of the forty-third embodiment through the fifty-eighth embodiment wherein the plurality of pumping units 60 and the manifold 120 are above a surface 20.

A sixtieth embodiment which is a fluid distribution system of any of the forty-third embodiment through the fifty-ninth embodiment wherein each of the plurality of pumping units 62, 82, and 102 comprises at least two pumps 64, 66; 84, 86; 104, and 106.

A sixty-first embodiment which is a fluid distribution system of any of the forty-third embodiment through the sixtieth embodiment wherein each pump 64 of the plurality of pumping units 62, 82, and 102 has a respective fluid end 74 in fluid communication with a respective pressure test pump 78 upstream of a respective check valve 136.

A sixty-second embodiment which is a method of pressure testing a manifold and piping coupled to a wellhead and isolated from fluid flow through the wellhead, comprises: starting pumping of a fluid by all pumping units in fluid communication with the manifold and piping to pressurize the manifold and piping to a first predetermined pressure; upon reaching the first predetermined pressure, halting pumping of fluid by one or more of the all pumping units (e.g., halting pumping by all of the pumping units or by less than all of the pumping units to provide one or more continued-operating pumping units); continuing pumping of fluid with at least one pressure test pump (and optionally one or more continued-operating pumping units) to pressurize the manifold and piping to a second predetermined pressure; and upon reaching the second predetermined pressure, halting pumping of the fluid by the at least one pressure test pump (and prior to reaching the second predetermined pressure, halting pumping of fluid by the one or more continued-operating pumping units, if applicable).

A sixty-third embodiment which is a method of pressure testing a manifold and piping coupled to a wellhead and isolated from fluid flow through the wellhead, comprising: starting pumping of a fluid by all pumping units in fluid communication with the manifold and piping to pressurize the manifold and piping to a first predetermined pressure; upon reaching the first predetermined pressure, halting pumping of fluid by the all pumping units; continuing pumping of fluid with at least one pressure test pump to pressurize the manifold and piping to a second predetermined pressure; and upon reaching the second predetermined pressure, halting pumping of the fluid by the at least one pressure test pump.

A sixty-fourth embodiment which is a method of pressure testing a manifold and piping coupled to a wellhead and isolated from fluid flow through the wellhead, comprising: starting pumping of a fluid by one or more pumping units in fluid communication with the manifold and piping to pressurize the manifold and piping to a first predetermined pressure; upon reaching the first predetermined pressure, halting pumping of fluid by the one or more of a first number of pumping units; continuing pumping of fluid with at least one pressure test pump to pressurize the manifold and piping to a second predetermined pressure; and upon reaching the second predetermined pressure, halting pumping of the fluid by the at least one pressure test pump.

While embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_L$, and an upper limit, $R_U$, is disclosed, any number falling within the range is specifically disclosed. In particular, the following numbers within the range are specifically disclosed: $R=R_L+k*(R_U-R_L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. When a feature is described as "optional," both embodiments with this feature and embodiments without this feature are disclosed. Similarly, the present disclosure contemplates embodiments where this feature is required and embodiments where this feature is specifically excluded. Both alternatives are intended to be within the scope of the claim. Use of broader terms such as includes, includes, having, etc. should be understood to provide support for narrower terms such as consisting of, consisting essentially of, included substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure.

What is claimed is:

1. A method of conducting a pressure test on a piping and manifold system configured to provide fluid flow from a plurality of pumping units into a well via a wellhead, comprising:

connecting the plurality of pumping units to a discharge manifold, wherein a fluid outlet on each of the plurality of pumping units is in fluid communication with the discharge manifold via a respective discharge flowline;

connecting the wellhead of the well to the discharge manifold via a wellhead flowline;

isolating the wellhead from the fluid flow into the well to form a closed test system;

operating at least one and less than all of the plurality of pumping units to pump fluid into and pressurize the closed test system to a first predetermined pressure;

upon reaching the first predetermined pressure, halting pumping of fluid by the at least one of the plurality of pumping units;

continuing pumping of fluid into the closed test system with at least one pressure test pump to pressurize the manifold and piping to a final predetermined pressure; and upon reaching the final predetermined pressure, halting pumping of the fluid by the at least one pressure test pump, wherein the at least one pressure test pump has a horsepower equal to or less than 1% of a horsepower of each of the plurality of pumping units.

2. The method of claim 1 wherein the pressure test pump comprises a plunger pump, a piston pump, a pneumatic pump, a positive displacement pump, a gear pump, or a pressure intensifier.

3. The method of claim 1 wherein the pressure test pump is electrically driven.

4. The method of claim 1 wherein each discharge flowline comprises a respective check valve located between the discharge manifold and the respective fluid outlet of each of the plurality of pumping units.

5. The method of claim 4 wherein the fluid flow from the pressure test pump enters the closed test system upstream of one or more of the check valves.

6. The method of claim 4 wherein each of the plurality of pumping units comprises a fluid end having a body with a first discharge connection and a second discharge connection and wherein the discharge flowline is coupled to the first discharge connection and the pressure test pump is coupled to the second discharge connection.

7. The method of claim 1, wherein the first predetermined pressure is about 3,000 to about 5,000 psi and the final predetermined pressure is in a range of from about 10,000 to about 20,000 psi.

8. A method of conducting a pressure test on a piping and manifold system configured to provide fluid flow from a plurality of pumping units into a well via a wellhead, comprising:

connecting the plurality of pumping units to a discharge manifold, wherein a fluid outlet on each of the plurality of pumping units is in fluid communication with the discharge manifold via a respective discharge flowline;

connecting the wellhead of the well to the discharge manifold via a wellhead flowline;

isolating the wellhead from the fluid flow into the well to form a closed test system;

pumping fluid into and pressuring the closed test system with at least one pressure test pump to pressurize the manifold and piping to a final predetermined pressure; and upon reaching the final predetermined pressure, halting pumping of fluid by the at least one pressure test pump, wherein each discharge flowline comprises a respective check valve located between the discharge manifold and the respective fluid outlet of each of the plurality of pumping units and wherein the fluid flow from the pressure test pump enters the closed test system upstream of one or more of the check valves.

9. A method of pressure testing a manifold and piping coupled to a wellhead and isolated from fluid flow through the wellhead, comprising:

starting pumping of a fluid by all pumping units in fluid communication with the manifold and piping to pressurize the manifold and piping to a first predetermined pressure;

upon reaching the first predetermined pressure, halting pumping of fluid by the all pumping units;

continuing pumping of fluid with at least one pressure test pump to pressurize the manifold and piping to a second predetermined pressure; and upon reaching the second predetermined pressure, halting pumping of the fluid by the at least one pressure test pump, wherein each discharge flowline comprises a respective check valve located between a discharge manifold and a respective fluid outlet of each of the plurality of pumping units, and wherein each of the plurality of pumping units comprises a fluid end having a body with a first discharge connection and a second discharge connection and wherein the discharge flowline is coupled to the first discharge connection and the pressure test pump is coupled to the second discharge connection.

10. The method of claim 9 wherein the fluid flow from the first discharge connection through the respective discharge flow line and the respective check valve to the manifold.

11. The method of claim 10 wherein the body further comprises a plurality of substantially horizontally spaced bores each having a plunger disposed therein and configured to reciprocate within the bore during suction and discharge strokes.

12. The method of claim 11 wherein each pumping unit comprises two fluid ends and two pressure test pumps, and each fluid end has a respective pressure test pump connected to the respective second discharge connection.

13. The method of claim 12 wherein the pumping unit comprises an electric motor coupled to the two fluid ends and configured to reciprocate the plungers.

14. The method of claim 9 wherein the fluid flow from the at least one pressure test pump enters a closed test system upstream of all of the check valves.

15. The method of claim 14 wherein the at least one pressure test pump further comprises a plurality of pressure test pumps, wherein a total number of the plurality of pressure test pumps is the same as a total number of the plurality of pumping units.

16. A method of conducting a pressure test on a piping and manifold system configured to provide fluid flow from a plurality of pumping units into a well via a wellhead, comprising:

connecting the plurality of pumping units to a discharge manifold, wherein a fluid outlet on each of the plurality of pumping units is in fluid communication with the discharge manifold via a respective discharge flowline;

connecting the wellhead of the well to the discharge manifold via a wellhead flowline;

isolating the wellhead from the fluid flow into the well to form a closed test system;

operating at least one and less than all of the plurality of pumping units to pump fluid into and pressurize the closed test system to a first predetermined pressure;

upon reaching the first predetermined pressure, halting pumping of fluid by the at least one of the plurality of pumping units;

continuing pumping of fluid into the closed test system with at least one pressure test pump to pressurize the manifold and piping to a final predetermined pressure; and upon reaching the final predetermined pressure, halting pumping of the fluid by the at least one pressure test pump, wherein each discharge flowline comprises a respective check valve located between the discharge manifold and the respective fluid outlet of each of the plurality of pumping units, and wherein the fluid flow from the pressure test pump enters the closed test system upstream of one or more of the check valves.

17. The method of claim 16 wherein the fluid flow from the at least one pressure test pump enters the closed test system upstream of two or more of the check valves.

18. The method of claim 16 wherein the fluid flow from the at least one pressure test pump enters the closed test system upstream of all of the check valves.

19. The method of claim 18 wherein the at least one pressure test pump further comprises a plurality of pressure test pumps, wherein a total number of the plurality of pressure test pumps is the same as a total number of the plurality of pumping units.

20. A method of pressure testing a manifold and piping coupled to a wellhead and isolated from fluid flow through the wellhead, comprising:

starting pumping of a fluid by all pumping units in fluid communication with the manifold and piping to pressurize the manifold and piping to a first predetermined pressure;

upon reaching the first predetermined pressure, halting pumping of fluid by the all pumping units;

continuing pumping of fluid with at least one pressure test pump to pressurize the manifold and piping to a second predetermined pressure; and upon reaching the second predetermined pressure, halting pumping of the fluid by the at least one pressure test pump, wherein each discharge flowline comprises a respective check valve located between the discharge manifold and the respective fluid outlet of each of the plurality of pumping units, and wherein the fluid flow from the pressure test pump enters the closed test system upstream of one or more of the check valves.

* * * * *